United States Patent [19]

Diamond

[11] 4,216,807

[45] Aug. 12, 1980

[54] APPLIANCE FOR USE WITH DISPENSING NOZZLES

[76] Inventor: Edward J. Diamond, 2200 East Ball Rd., Apt. #95, Anaheim, Calif. 92803

[21] Appl. No.: 935,685

[22] Filed: Aug. 21, 1978

[51] Int. Cl.[3] ..... B65B 3/04

[52] U.S. Cl. ..... 141/392; 74/526

[58] Field of Search ..... 141/1, 198, 206–220, 141/392; 251/111, 112, 284, 285, 90, 101; 24/3 E, 3 R, 73 B; 74/526; 46/16; 33/104; 52/638

[56] References Cited

U.S. PATENT DOCUMENTS

| | | | |
|---|---|---|---|
| 1,287,440 | 12/1918 | Riukin | 33/104 |
| 2,057,942 | 10/1936 | Fay | 46/16 |
| 2,387,120 | 10/1945 | Cohen | 52/638 |
| 3,610,298 | 10/1971 | Wood | 141/206 |
| 4,095,629 | 6/1978 | Jordan | 74/526 |

*Primary Examiner*—Houston S. Bell, Jr.

*Attorney, Agent, or Firm*—Edward C. Walsh

[57] ABSTRACT

An article of manufacture for use with automatic gas dispensing nozzles of the type having a handle and having an actuating lever. Typically the actuating lever is curved to be grasped by the user's fingers. In full service stations a latch is provided on the handle for latching the actuating lever in any one of three different positions wherein there are different rates of flow from the nozzle to accomodate different types of cars. Typically the nozzle shuts off automatically when the tank fills up. The article is used at self service pumps with nozzles not equipped with such a latch. The article is a holder member, preferably of triangular configuration, shaped to fit between the curved part of the actuating lever and a part of the nozzle handle to hold the lever in actuated position. The article is shaped to have three positions for holding the actuating lever, in any one of its three operating positions.

1 Claim, 5 Drawing Figures

16
20
28
11
30
10
13
26
17
21
18
12
22

64
17
21
10
16
56

52
40
50
60
42
64
3
72
66
10
54
44
68
28
17
11
12
26
70
18
16
56
13
16
18
3

64
66
16
10
42
68
13
11
26
18
17
17
54
18
12
56

64
66
18
10
42
12
68
13
17
54
17
16
26
16
56
11

APPLIANCE FOR USE WITH DISPENSING NOZZLES

BACKGROUND OF THE INVENTION

1. Field of the Invention

The field of the invention is that of automatic gas dispensing nozzles as ordinarily used in filling stations for dispensing gasoline to automobiles. The field of the invention is more particularly that of automatic gas nozzles used at self-service pumps as explained more in detail hereinafter.

2. Description of the Prior Art

Automatic gas dispensing nozzles are well known in the art. Typically such nozzles are equipped with an automatic shut-off valve which shuts off and terminates flow when the gas tank being filled is full and the gas comes up in the filler pipe. Typically these nozzles have a handle that can be grapsed, the handle having a guard part and there being an actuating lever for controlling the nozzle of curved shape, which is in a position between the handle and the guard part.

Typically at full service pumps wherein the station attendant operates the nozzle, the nozzle is equipped with a pivoted latch so that the actuating handle can be latched in any one of three positions at which there are different flow rates to accomodate different automobiles. At the self-service pumps the latch is removed from the nozzle and the customer has to hold the actuating handle himself, until the tank fills up. This represents a deficiency and lack in the prior art since customers do not wish to have to hold the actuating lever of the nozzle and furthermore it is possible that gasoline may be splashed on their clothing. The herein invention provides an article which fulfills this need and overcomes the lack, all as described in detail hereinafter.

SUMMARY OF THE INVENTION

The invention has been briefly described in the abstract and the prior art environment in which it finds utility is described in the description of the prior art.

A preferred exemplary form of the invention is described in detail hereinafter, this exemplary form representing the best mode of practicing the invention as presently conceived and understood.

In the exemplary form of the invention it takes the form of a rigid generally flat article of generally triangular shape. Preferably the sides are curved rather than having straight configuration. The article is provided at the apices of the triangular shape with thickened portions to provide reinforcement and strength.

The article as described is positionable between the curved part of the actuating lever of the nozzle and the guard part of the handle. The triangular shape of the article is irregular, rather than uniform, so that it can be positioned as described in three different orientations, so that the actuating lever is held in any one of three different positions providing for different flow rates corresponding to the positions that the actuating lever is held in when held by the pivoted latch as previously described, with which the nozzles at the full service pumps are equipped with as previously described.

In the light of the foregoing, the primary object of the invention is to provide a simplified and effective means or article adapted for holding the actuating lever of an automatic dispensing nozzle in an acutated position and more particularly in any one of various positions representing different rates of flow.

A further object is to make available an article as in the foregoing in the form of a rigid flat member of generally triangular shape configurated to be positionable in any one of several positions between the curved part of the actuating lever and the guard part of the nozzle handle thereby holding the actuating lever in any one of several desired flow rate positions.

A further object is to realize an article as in the foregoing which is of irregular triangular shape with circular thickened reinforcing portions or members at the apices with transverse bores through the thickened portions.

Further objects and additional advantages of the invention will become apparent from the following detailed description and annexed drawing.

DESCRIPTION OF THE PREFERRED EMBODIMENT

Figure 1:
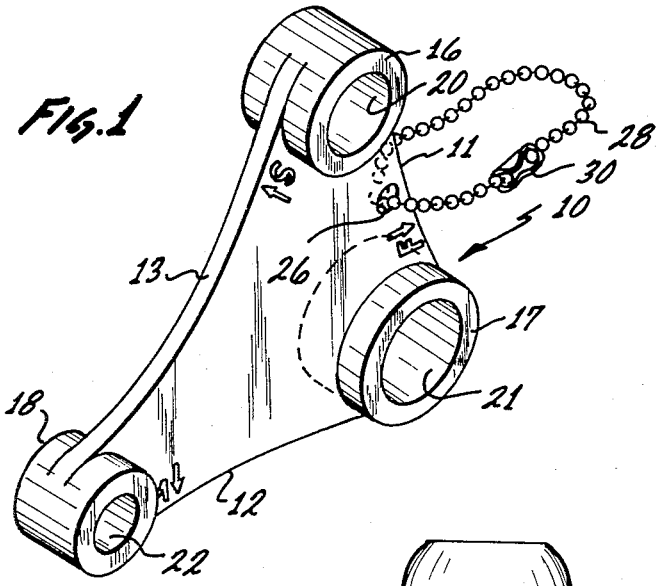
FIG. 1 is a pictorial view of a preferred form of the article of the invention.

Referring to the drawings, FIG. 1 is a view of the exemplary form of the invention. The article is a flat rigid member which may be made of plastic or other suitable material. It is of irregular triangular shape as shown having sides as designated at 11, 12 and 13. Preferably these sides are curved as shown. The sides are of different length, as will be explained more in detail presently.

At the apices of the triangle are thickened reinforcing parts or members as designated at 16, 17 and 18. As shown these reinforcements are in the form of integral cylindrical portions or members having cylindrical bores as designated at 20, 21 and 22. The axial extent, that is the thickness of these members is substantially greater than the thickness of the flat part of the article 10 as shown.

The flat part of the article has a hole in it as designated at 26 through which extends a link chain 28 having a manually separable coupling in it as designated at 30. As will be explained hereinafter, the automobile owner may have one of the articles as described, carrying it on the chain 28 for usage at self-service gas stations.

Figure 2:
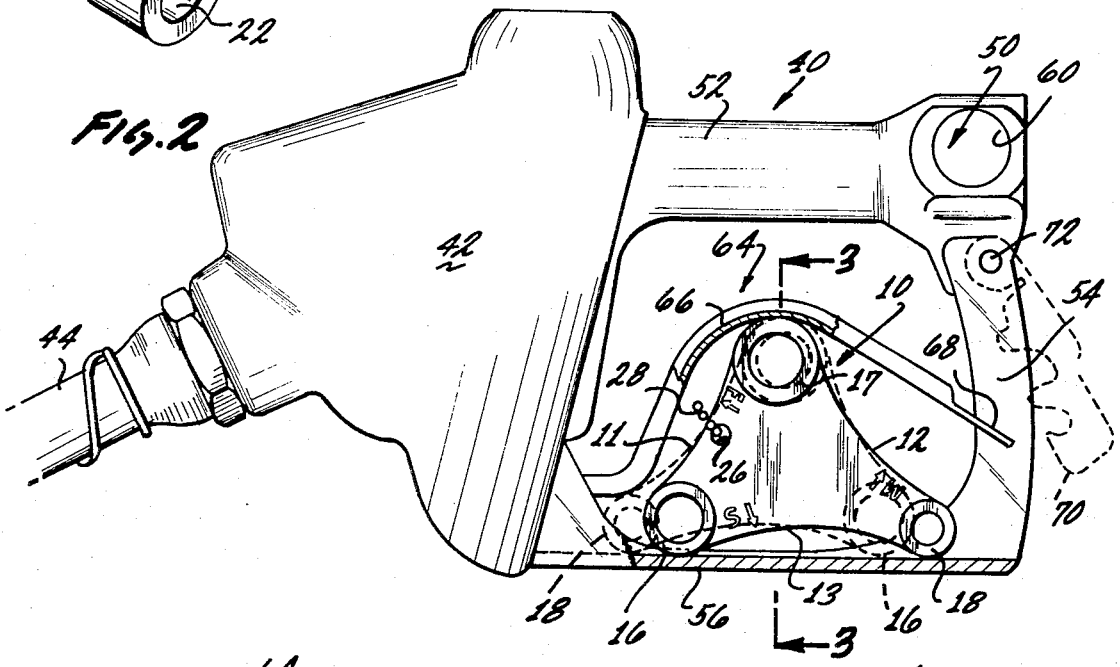
FIG. 2 is a side elevational view of a typical automatic gas nozzle having the article of the invention in position holding the actuating lever.

FIGS. 2–5 illustrate the utilization of the article in connection with an automatic gas nozzle. In FIG. 2 numeral 40 designates a typical automatic gas nozzle having a body part 42 within which is an automatic valve which will shut off automatically in response to gas rising in the filler pipe of the automobile. Numeral 44 designates an extending nozzle, extending from the body 42 which fits into the filler pipe.

The gas nozzle has an integral handle part as designated at 50 having a grip 52 at the upper part and a handle guard 54 including a flat bottom part or section 56 which is parallel to the grip part 52. As shown, typically the grip part 52 has a hole through it as designated at 60.

Numeral 64 designates a curved actuating or control lever which controls the valve in the body 42 of the nozzle. The handle has an intermediate curve in it as designated at 66 and it has a tip end as designated at 68. Typically the nozzles as shown used at full service pumps are provided with a pivoted latch member as shown in broken lines and as designated at 70, pivoted on a pivot member 72 extending through the grip 52. Typically the latch member 70 has a group of, for example three notches in it as shown so that the tip end 68 can be latched into anyone of these notches so as to hold the lever in any one of three positions for three different rates of flow depending on the car being serviced. Rates of flow are different for different cars. For smaller cars the rate of flow must be less, otherwise the gas will back up into the filler nozzle causing the nozzle to shut off before the tank is full.

Figure 3:
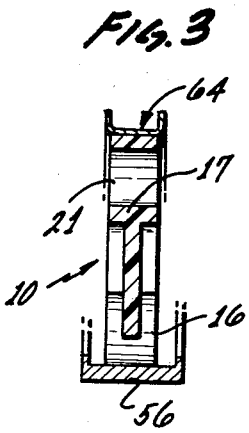
FIG. 3 is a sectional view taken along the line 3—3 of FIG. 2.

FIG. 2 shows the holder 10 in position between the curved part 66 of the lever 64 and the bottom part 56 of the guard. Typically the guard part of the nozzle underneath the handle is of channel shape as illustrated in FIG. 3, the channel having a greater width than the thickness of the reinforcing members at the apices of the holder 10. The three sides 11, 12 and 13 of the article 10 are of different lengths. In the position of FIG. 2 the longer side 13 is adjacent to the part 56 of the guard with reinforcing members 16 and 18 fitting in the channel 56. The reinforcing member 17 fits against the inside of the curved part 66 of the lever 64. In this position the handle is held in the position of the lowest rate of flow of the three positions. When the tank fills up the nozzle automatically shuts off and the user can then remove the article 10 and retain it for subsequent use. As illustrated in FIG. 2, the article 10 may be positioned to hold the lever 64 in either of two positions the second one being illustrated by dotted lines, the flow rate being the same for either of these two positions of the article 10. Thus, the user can insert the article either way for this particular rate of flow.

Figure 4:
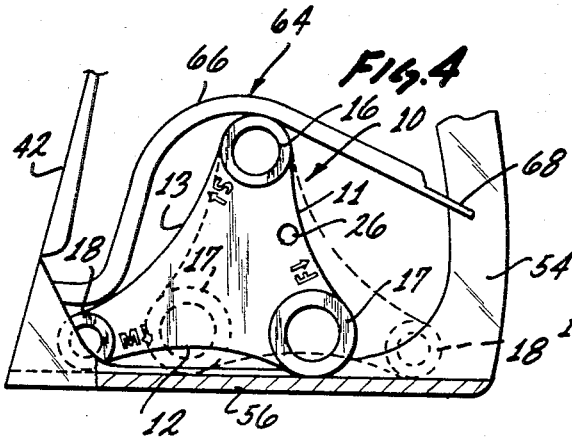
FIGS. 4 and 5 are illustrative views illustrating the article of the invention in its two other positions holding the actuating lever of the gas nozzle.

In FIG. 4 the article 10 is positioned as shown with the side 12 adjacent to the part 56 of the guard with the reinforcing portions 17 and 18 in channel 56 and with the reinforcing part 16 against the curved part 66 of the lever 64. In this position the actuating lever is held in an intermediate position, that is in a wider open position of the valve.

In this position of the article 10, also it can have either of two orientations, the second one being in dotted lines which similarly holds the actuating lever 66, so that the user can put it in either way with the same results.

Figure 5:
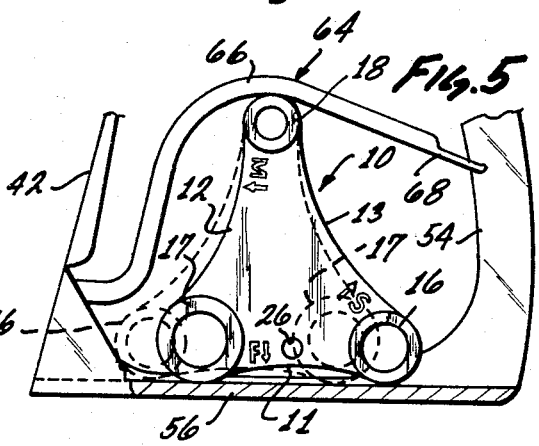

FIG. 5 shows the article 10 in position with its shorter side 11 adjacent to the part 56 of the guard. The reinforcing portion 18 at that apex of the triangle is adjacent to the curved part 66 of the lever 64. In this position the article 10 holds the actuating lever in its third position which is the position of maximum flow.

Designations are provided on the article of S;M; and F; designating slow, medium, and fast rates of flow. Adjacent to the letters are arrows which identify for the user the position that the article has for each rate of flow and as indicated in the drawings.

From the foregoing those skilled in the art will readily understand the nature of the invention, its construction and the manner of its utilization. The article is an extremely simple, and economical one, but yet very effective for its purpose and the utilization of which fulfills a distinct need in the operation of self-service gas dispensing equipment. The owner and user can carry the article in his automobile and then can use it at the self-serving dispensing station whenever needed. The usage is very simple, but yet very stable and positive.

The foregoing disclosure is representative of a preferred form of the invention and is to be interpreted in an illustrative rather than a limiting sense, the invention to be accorded the full scope of the claims appended hereto.

What is claimed is:

1. In combination, an automatic gas dispensing nozzle of the type having a handle, a guard of inwardly facing channel shape in section and a variable position actuating lever positionable in at least three positions; a substantially planar rigid member of triangular shape with sides of different lengths and the apices of which are at respectively different distances from the sides opposite those apices, each of said apices being defined by a cylindrical enlargement arranged with its axis extending transverse to the plane of said member; and extending laterally on both sides thereof; said member being positioned between said actuating lever and said guard with a selected one of said enlargements engaging said lever and the other two enlargements being seated within the channel of said guard for holding said lever in a selected one of said positions.

* * * * *